United States Patent [19]

Miller

[11] Patent Number: 4,869,442

[45] Date of Patent: Sep. 26, 1989

[54] SELF-DEPLOYING AIRFOIL

[75] Inventor: Ira E. Miller, Santa Ana, Calif.

[73] Assignee: Aerojet-General Corporation, La Jolla, Calif.

[21] Appl. No.: 239,805

[22] Filed: Sep. 2, 1988

[51] Int. Cl.[4] ..... F42B 13/32

[52] U.S. Cl. ..... 244/3.28; 244/3.29

[58] Field of Search ..... 244/3.27, 3.28, 3.29, 244/49

[56] References Cited

U.S. PATENT DOCUMENTS

| | | | |
|---|---|---|---|
| 2,402,468 | 6/1946 | Thompson | 244/49 |
| 2,572,421 | 10/1951 | Abel, Jr. | 244/49 |
| 3,063,375 | 11/1962 | Hawley et al. | 244/3.28 |
| 3,098,445 | 7/1963 | Jackson | 244/3.28 |
| 3,127,838 | 4/1964 | Moratti et al. | 244/3.28 |
| 3,819,132 | 6/1974 | Rusbach | 244/3.28 |
| 3,918,664 | 11/1975 | Grosswendt | 244/3.28 |
| 4,323,208 | 4/1982 | Ball | 244/3.28 |
| 4,592,525 | 6/1986 | Madderra et al. | 244/3.28 |
| 4,664,339 | 5/1987 | Crossfield | 244/3.28 |
| 4,667,899 | 5/1987 | Wedertz | 244/3.28 |

FOREIGN PATENT DOCUMENTS

| | | | |
|---|---|---|---|
| 0013096 | 7/1980 | European Pat. Off. | 244/49 |
| 0251890 | 1/1988 | European Pat. Off. | 244/49 |

*Primary Examiner*—Deborah L. Kyle
*Assistant Examiner*—Michael J. Carone
*Attorney, Agent, or Firm*—Leonard Tachner

[57] ABSTRACT

A self-deploying airfoil mounted on the body of a device such as an artillery shell projectile and folded down and forward with respect to the relative airstream. The airfoil is attached to a yoke by a pivot pin. The yoke shaft is pivoted in the body in a manner to allow it to pivot 90 degrees tangentially with respect to the body. The airfoil assembly may be retained by a cover which is removable to deploy the airfoil. The shaft of the yoke is mounted at a small angle to the axis of the body so that the airfoil has an angle of attack relative to the airstream when it pivots tangentially outward. When the cover is removed, a spring starts the airfoil rotating out into the airstream where drag drives it to the 90 degree position. The yoke is locked in the 90 degree position by a yoke lock pin. The airfoil, which is rigidly attached by pins to the pivot pin, cannot begin to rotate about the pivot pin until the yoke has rotated 90 degrees. A flat on the head of the pivot pin rides on the surface of the body preventing rotation in a vertical direction until the 90 degrees of tangential rotation has been completed. Aerodynamic lift acting on the airfoil then rotates it upward to a position about normal to the body axis where it is locked by an airfoil lock pin.

7 Claims, 3 Drawing Sheets

SELF-DEPLOYING AIRFOIL

BACKGROUND OF THE INVENTION

1. Field of the Invention

This invention relates in general to deployable airfoil structures and particularly pertains to a self-deploying airfoil structure suitable for use on an artillery projectile or tube launched missile.

2. Prior Art

Improved ballistic performance and maneuverability is achieved through the use of airfoils on a projectile or missile and the like. However, in many devices employing aerodynamic forces for stability, lift or drag, it is necessary that airfoils such as wings, fins and the like be stowed within the body before deployment. The conventional method for doing so is to pivot an airfoil at one end and deploy it radially outward. This requires that a long axial slot must be cut in the skin of the projectile and the airfoil permitted to extend its full width into the body of the device. Such slots reduce the structural integrity of the skin and may seriously interfere with packaging of components. The present invention provides an airfoil which does not project into the skin its full width, thereby enhancing packaging efficiency and structural integrity. The present invention is instead designed to be self deployed from a stowed position in which the airfoil is folded down and forward with respect to the relative airstream and in a position which is substantially contiguous with the radial skin of the projectile.

The most relevant prior art known to the applicant is U.S. Pat. No. 4,664,339 to Crossfield issued May 12, 1987 and relating to a missle appendage deployment mechanism in which a radially contiguous stowed airfoil such as a wing or fin, when deployed rotates upwardly from a stowed into a feathered vertical position into the airstream of the missle or projectile. While this upward rotation from the stowed position is efficient from the standpoint of motion, it unfortunately requires that the attached end of the airfoil have a very complex shape in order to be compatible with a clevis with which is cooperates in order to achieve simultaneous rotation in two planes. The present invention overcomes the need for this complex prior art structure in the airfoil and cooperating elements by utilizing a novel combination of sequential motions the first of which is a tangential rotation in a plane tangential to the radial wall of the projectile and the second of which is a vertical rotation in a plane perpendicular to the axis of the projectile. While both the present invention and the Crossfield device exploit inherent aerodynamic forces to complete deployment of the airfoil, the unique sequential motion of the present invention permits the use of more conventional and thus less expensive structures both in the airfoil and in the attendant pivoting member or yoke thereby reducing the cost and complexity of the invention as compared to the prior art.

Other relevant prior art includes the following:

U.S. Pat. No. 4,323,208 to Ball is directed to a folding fin assembly for some type of flight vehicle which may be a guided/unguided missile. This disclosure relates to a two axis rotation and the fin is rotated about the axis Z—Z. The structure is mounted on a turntable which is rotatable with reference to the base about the axis W—W.

U.S. Pat. No. 3,098,445 to Jackson is directed to an aerodynamically supported rocket system. It uses a double rotation. When the blades are pivoted about the pivotal mounting of sleeves from the folded state of FIG. 1 to the radially extended state of FIG. 2, the cam arms engage the bottoms of the cam slots to rotate the blades to predetermined angular positions. Alternatively as the blades are pivoted to the folded state of FIG. 1, the cam arms engage the tops of the cam slots to rotate the blades to the fin position.

U.S. Pat. No. 4,667,899 to Wedertz is directed to a double swing wing self-erecting missible wing structure. This reference provides for a recess in the air frame in which the wing is stored in a retracted position. Each wing has a corresponding recess and there is a double rotation.

U.S. Pat. No. 3,063,375 to Hawley et al is directed to still another type of folding wing or folding fin. There is disclosed a rotation about an axis normal to the longitudinal axis of the missle and then a rotation about this axis to put it into the position shown in FIG. 6 for flight.

SUMMARY OF THE INVENTION

The present invention overcomes the aforementioned disadvantages of the prior art by providing a self-deploying airfoil mounted on the body of a device such as an artillery shell projectile and folded down and forward with respect to the relative airstream. The airfoil is attached to a yoke by a pivot pin. The yoke shaft is pivoted in the body in a manner to allow it to pivot 90 degrees tangentially with respect to the body. The airfoil assembly may be retained by a cover which is removable to deploy the airfoil. The shaft of the yoke is mounted at a small angle to the axis of the body so that the airfoil has an angle of attack relative to the airstream when it pivots tangentially outward. When the cover is removed, a spring starts the airfoil rotation out into the airstream where drag drives it to the 90 degree position. The yoke is locked in the 90 degree position by a yoke lock pin. The airfoil, which is rigidly attached by pins to the pivot pin, cannot begin to rotate about the pivot pin until the yoke has rotated 90 degrees. A flat on the head of the pivot pin rides on the surface of the body preventing rotation in a vertical direction until the 90 degrees of tangential rotation has been completed. Aerodynamic lift acting on the airfoil then rotates it upward to a position about normal to the body axis where it is locked by an airfoil lock pin. Because of the unique combination of sequential, tangential and vertical rotation, the airfoil structure of the present invention may be relatively simple and easy to fabricate at relatively low cost. Additionally, the yoke and yoke pin of the present invention may be of relatively conventional configuration thereby obviating any requirement for special tooling or unique shapes that require costly manufacturing processes.

OBJECTS OF THE INVENTION

It is therefore principal object of the present invention to provide a self-deployable airfoil for use on a projectile such as an artillery shell for aerodynamic stabilization thereof, the airfoil being deployed by the pressure of the airstream due to the motion of the projectile, the airfoil comprising relatively conventional geometric shapes for ease of production and low cost.

It is an additional object of the present invention to provide a self-deployable airfoil of the type used in projectiles such as artillery shells for stabilizing such projectiles during flight, the airfoil being deployable in response to the pressure of the airstream in two discrete sequential motions including a first such motion which constitutes a tangential rotation in the plane of a tangent to the projectile and a second such motion which constitutes a vertical rotation in a plane perpendicular to the axis of the projectile.

It is still an additional object of the present invention to provide an airstream instigated deployable airfoil for stabilizing the aerodynamic characteristics of a projectile such as an artillery shell wherein the airfoil and the structure used for rotating the airfoil into proper position during deployment are of relatively conventional shape and geometry for minimizing the cost and manufacturing complexity thereof and wherein airfoil deployment is accomplished in two discrete steps, the first being a tangential rotation of the airfoil in a plane tangential to the projectile and the second being a vertical rotation of the airfoil in a plane perpendicular to the axis of the projectile.

BRIEF DESCRIPTION OF THE DRAWINGS

The aforementioned objects and advantages of the present invention as well as additional and advantages thereof will be more fully understood hereinafter as a result of a detailed description of a preferred embodiment when taken in conjunction with the following drawings in which.

DETAILED DESCRIPTION OF A PREFERRED EMBODIMENT

Figure 1:
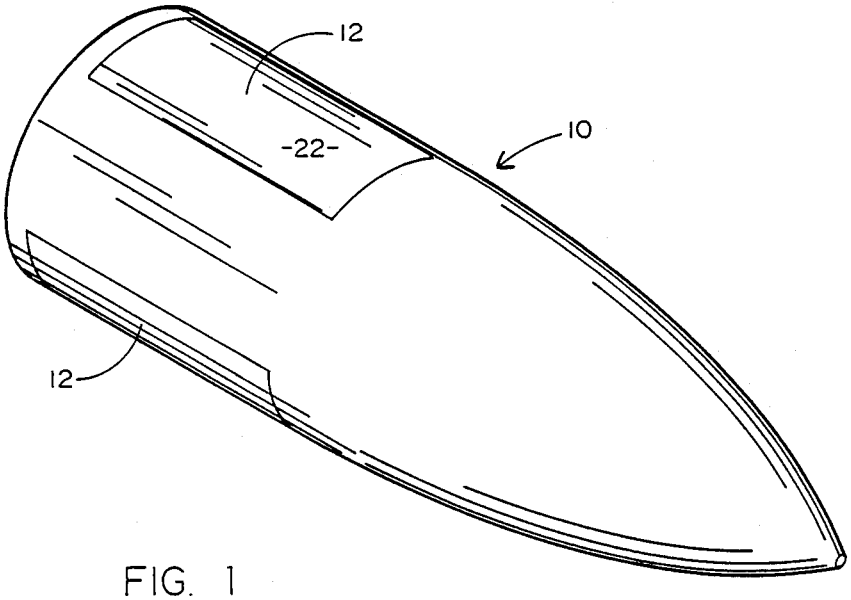
FIG. 1 is an isometric view of a projectile, the type of which may use an airfoil assembly of the present invention.
Figure 2:
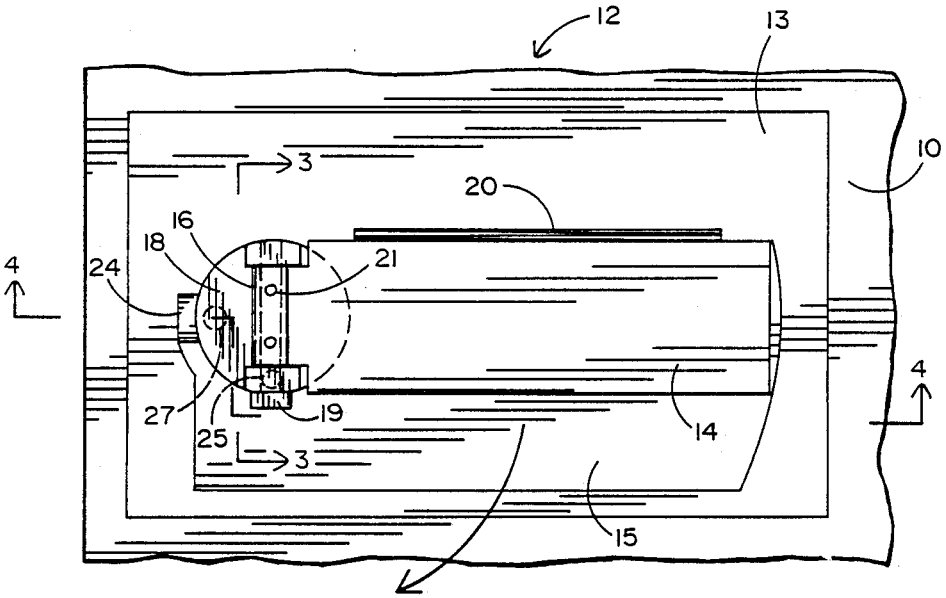
FIG. 2 is a top elevational view of the present invention.

Referring first to FIGS. 1 and 2 it will be seen that a projectile 10 would typically have a plurality of airfoil assemblies 12 of the present invention distributed radially around its exterior skin in the manner shown in FIG. 1. Each such assembly is provided, at least initially, with an outer cover 22 to protect the assemblies 12 and to provide a smooth, continuous surface in the projectile 10 such as to permit the firing of the projectile from a gun tube. As seen best in FIG. 2 beneath the outer cover 22 there is provided a recess 13 in which there is positioned an airfoil 14 lying in its stowed position initially parallel to the projectile 10. Airfoil 14 is free at its forward end and is connected at its aft end to a pivot pin 16 which forms part of a rotatable yoke 18 and has at one end thereof a head 19. As seen further in FIG. 2, the yoke 18 is of a circular configuration and is adapted to be rotatable in a clockwise direction as seen in FIG. 2 whereby airfoil 14 may rotate 90 degrees along a plane tangential to the projectile 10. A flat area 15 is provided to permit the airfoil to rotate in this manner. The airfoil 14 is secured to pivot pin 16 by a pair of rivets 21.

A leaf spring 20 is provided along the top edge of airfoil 14 as seen in FIG. 2 in order to initiate the 90 degree tangential rotation of the airfoil along the flat 15. It will be understood that the force necessary to fully rotate the airfoil 14 through 90 degrees of tangential rotation along flat 15, is provided by the pressure of the airstream into which the airfoil is positioned initially by the spring 20. After the airfoil 14 has rotated through 90 degrees along plane 15, the same airstream pressure which produced that complete rotation then forces the airfoil into a vertical mode of rotation whereby pivot pin 16 rotates along its axis until the airfoil is fully deployed and locked into that position in the manner to be described hereinafter. More specifically, referring now to FIG. 3 it will be seen that pivot pin 16 is provided with a well 34. It will also be seen in FIG. 3 that along the axis of rotatable yoke 18, there is provided a lock pin 30 which rests on a compressed spring 32 within a cylindrical jacket 33. It will be understood that when the airfoil 4 is rotated into its fully deployed position wherein it has completed the vertical rotation, pivot pin 16 is rotated 90 degrees until well 34 is aligned with lock pin 30 which enters the well and secures the airfoil in that position.

Figure 3:
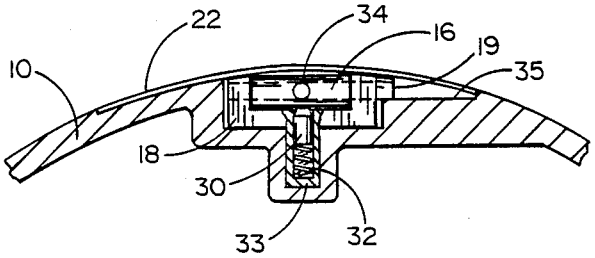
FIG. 3 is a cross-sectional view of a portion of the invention taken along lines 3—3 of FIG. 2.
Figure 4:
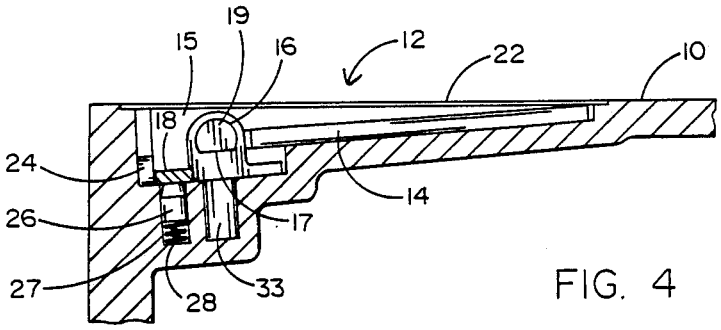
FIG. 4 is an additional cross-sectional view of the invention taken along lines 4—4 of FIG. 2.

It will also be seen in FIGS. 2, 3 and 4 that pivot pin 16 is provided with a head 19 which has a flattened edge 17. Flat surface 17 normally rests in close proximity to the underlying surface 35 of projectile 10 which prevents the head and therefore the pivot pin from rotating until the head is aligned with a slot 24 which is seen best in FIGS. 2 and 4 but it will be understood that such alignment does not occur until the yoke 18 has been rotated 90 degrees by rotation of the airfoil through its 90 degree tangential rotation into the configuration shown in FIGS. 5 and 6.

Figure 5:
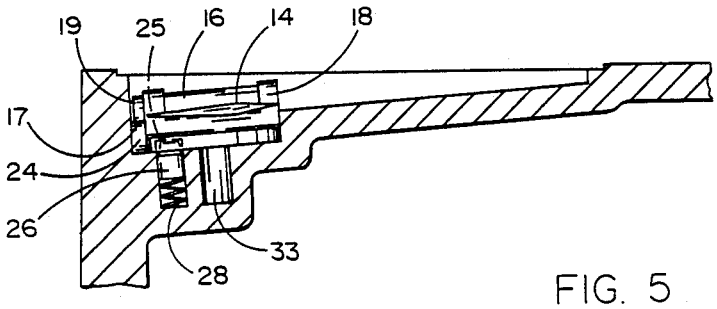
FIG. 5 is a cross-sectional view of the invention similar to that shown in FIG. 4 but illustrating the invention after it has completed its first step of deployment.
Figure 6:
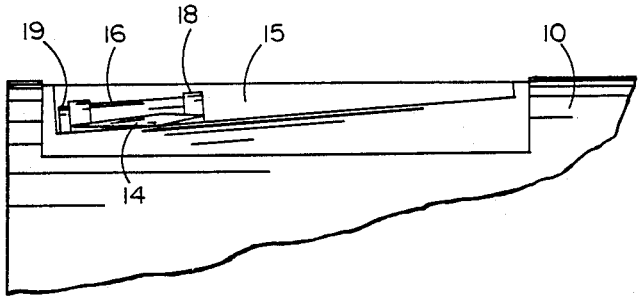
FIG. 6 is an elevational side view of the invention again illustrating the partially deployed configuration as shown in FIG. 5.
Figure 7:
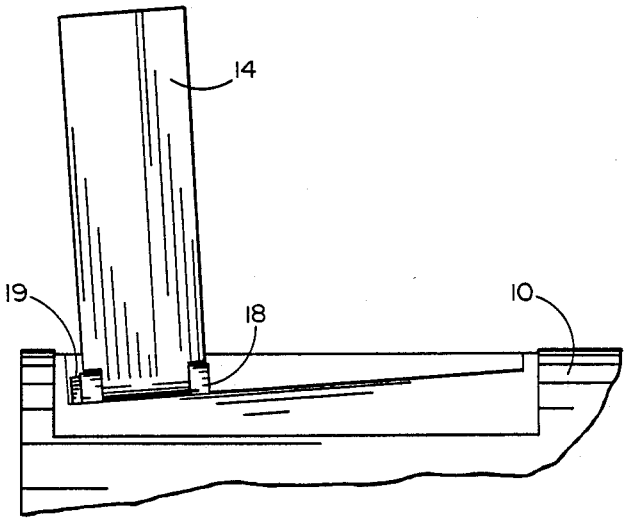
FIG. 7 is a elevational side view of the invention in its fully deployed configuration.

As seen in FIG. 2 and FIG. 4, the bottom surface of yoke 18 is provided with a recess 25 while a portion of the adjacent structure of the projectile 10 offset from the center of the yoke is provided with a well 27 in which there is positioned a lock pin 26 resting on a compressed spring 28. Lock pin 26 is designed to rest against the underlying surface of yoke 18 compressing spring 28 until it is aligned with well 27 at which point the spring forces the lock pin into the well thereby locking the yoke in its rotated configuration shown in FIG. 5 and 6. Thus after the airfoil 14 has rotated tangentially in a clockwise direction (as seen in FIG. 2) a full 90 degrees, the yoke 18 is locked by the lock pin 26 and the flat surface 17 of head 19 of the pivot pin 16 is aligned with the slots 24 permitting a pivot pin 16 to rotate. The airfoil 14 can then rotate through its vertical motion into its fully deployed configuration as shown in FIG. 7. As seen in FIGS. 4 and 5, the yoke axis is angled slightly relative to the normal to the projectile axis to further facilitate deployment.

It will now be understood that what has been disclosed herein comprises a self-deploying airfoil mounted on the body of a device such as an artillery projectile and initially folded down and forward with respect to the relative airstream. The airfoil is attached to a yoke by a pivot pin. The yoke shaft is pivoted in the body in a manner to allow it to pivot 90 degrees tangentially. The airfoil assembly is retained by a cover which is removed to deploy the airfoil. The shaft of the yoke is mounted at a small angle to the normal to the axis of the body so that the airfoil has an angle of attack relative to the airstream when it pivots tangentially outward.

When the cover is removed, a spring starts the airfoil with a yoke rotating out into the airstream where drag drives it to the 90 degree position until the yoke is secured by a yoke lock pin. The airfoil, which is rigidly attached by pins to a pivot pin, cannot begin to rotate about the pivot pin until the yoke has rotated 90 degrees. A flat on the head of the pivot pin rides on the surface of the body preventing rotation until 90 degrees of rotation of the yoke has been completed. Such rotation uncovers a slot in the body, releasing the head of the pivot pin. Aerodynamic lift acting on the airfoil then rotates it upward to a position substantially normal to the body axis where it is locked by an airfoil lock pin.

The airfoil uses aerodynamic forces to complete deployment requiring only a small leaf spring to begin the tangential rotation of the airfoil. The air drag on the airfoil completes the tangential rotation. Because the axis of the yoke is tilted a few degrees backward from normal, the airfoil has an angle of attack relative to the airstream. This creates an aerodynamic lift on the airfoil in a direction to rotate the airfoil 90 degrees upward to a fully deployed position. The aerodynamic lift falls to zero in the fully deployed position of the airfoil. Unlike the prior art most relevant to the present invention, the airfoil herein disclosed exhibits two discrete sequential rotational motions the first of which is tangential to the projectile skin and the second of which is in a plane perpendicular to the axis of the projectile. Such simple sequential steps of rotation permit the airfoil and attendant yoke structure to be of a relatively simple configurations which are less complex and thus less costly to manufacture.

Those having skill in the art to which the present invention pertains will now, as a result of the applicant's teaching herein perceive various modifications and additions which may be made to the invention. By way of example, shapes other than the particular shape and configuration of the airfoil and yoke herein disclosed may be used to produce the desired combination of tangential and vertical rotation relative to a projectile to produce the deployed configuration of an airfoil of relatively simple and producible structure. Accordingly, all such modifications and additions are deemed to be within the scope of the invention which is to be limited only by the claims appended hereto.

I claim:

1. An airstream-deploying airfoil assembly for use in conjunction with a projectile of the type having a longitudinal axis and a radial surface; the assembly comprising:

an airfoil having one end free and one end affixed as a point of rotation;

a yoke positioned for rotation substantially in said radial surface; and a pivot pin attached to said affixed end of said airfoil and rotatably affixed to said yoke for rotation therein;

said airfoil being stowed in a position tangential to said radial surface and substantially parallel to said longitudinal axis and being first rotatable through about 90 degrees with said yoke in a plane tangential to said radial surface and thereafter rotatable through about 90 degrees with said pivot in a direction substantially perpendicular to said longitudinal axis.

2. The assembly recited in claim 1 further comprising means preventing rotation to said pivot pin until completion of rotation of said yoke.

3. The assembly recited in claim 1 further comprising means for locking said yoke after rotation thereof.

4. The assembly recited in claim 1 further comprising means for locking said pivot pin after rotation thereof.

5. The assembly recited in claim 1 wherein said yoke has an axis of rotation which is angled relative to the normal to the longitudinal axis.

6. A self-deployable wing for an artillery shell comprising:

means for first rotating the wing through about 90 degrees from a stowed position parallel to the shell in a plane tangential to the shell;

means for subsequently rotating the wing through about 90 degrees in a direction substantially perpendicular to the artillery shell;

means for preventing said subsequent rotating until completion of said first rotating; and means for locking said wing into its fully deployed position upon completion of said subsequent rotating.

7. The self-deployable wing recited in claim 6 wherein said first rotating means comprises a spring.

* * * * *

Notice of Adverse Decisions in Interference

In Interference No. 102,508, involving Patent No. 4,869,442, I. E. Miller, SELF-DEPLOYING AIRFOIL, final judgment adverse to the patentees was rendered May 20, 1991, as to claims 1-4, 6, and 7.

(*Official Gazette August 27, 1991*)